US005951277A

United States Patent [19]

Parham

[11] Patent Number: 5,951,277

[45] Date of Patent: Sep. 14, 1999

[54] REFRACTORY HOOD FOR CIRCULATING FLUIDIZED BED

[75] Inventor: Robert L. Parham, Denver, Colo.

[73] Assignee: The Robert L. Parham Trust, Daytona Beach Shores, Fla.

[21] Appl. No.: 08/740,710

[22] Filed: Nov. 1, 1996

[51] Int. Cl.[6] ..... F23D 21/00

[52] U.S. Cl. ..... 431/170; 122/4 D; 432/58; 110/245; 422/139

[58] Field of Search ..... 431/170; 122/4 D; 432/58; 110/245; 422/139, 145

[56] References Cited

U.S. PATENT DOCUMENTS

| | | | |
|---|---|---|---|
| 4,377,119 | 3/1983 | Noack | 122/4 D |
| 4,766,851 | 8/1988 | Emsperger | 110/245 |

*Primary Examiner*—Carroll B. Dority
*Attorney, Agent, or Firm*—Gibson, Dunn & Crutcher LLP

[57] ABSTRACT

A shield in the form of a "cast refrac" (S.U.B.S.) for a diffuser port in a circulating fluidized bed to deflect eroding particulates away from the port. The S.U.B.S. includes an upper portion with a tear-drop shape, a lower portion, and side intermediate portions to surround the port, and an attached insert to be received by or around the port.

2 Claims, 2 Drawing Sheets

REFRACTORY HOOD FOR CIRCULATING FLUIDIZED BED

FIELD OF THE INVENTION

The present invention relates to the field of electrical power generation, utilizing circulating fluidized bed boilers, and in particular a "cast-refrac" start up burner shield (S.U.B.S.) to shield a circulating fluidized bed diffuser from the heat and abrasive effects of ash and other debris.

BACKGROUND OF THE INVENTION

Electricity is typically generated by producing steam which drives a turbine to operate an electrical generator. The steam can be provided by a variety of methods, including the radioactive decay of uranium in nuclear reactors, the combustion of coal, the burning of oil, or other means. One such other means is the combustion of non-traditional fuels such as wood, paper, trash, and fossil fuels not suitable for pulverized coal boilers or oil boilers, such as low quality coal or anthracite. Such fuels may be combusted to produce steam in a boiler called a circulating fluidized bed.

Circulating fluidized bed boilers have several advantages over pulverized coal boilers. Coal is not readily available everywhere. More particularly, coal that combusts with low noxious emissions is not readily available everywhere and is sometimes prohibitively expensive. Emissions are closely regulated by environmental regulations directed toward sulfur and nitrogen oxides as well as ash content. Circulating fluidized bed systems produce ash, but tend to be low in sulfur and nitrogen oxide emissions. They can be used to combust coal, and also low bituminous coal, anthracite, lignite, paper, wood and even trash.

A typical circulating fluidized bed system includes a combustor, a solids recycle loop or "cyclone," and an ash collector. The combustor functions to combust fuel; the solids recycle loop recirculates uncombusted solid fuel exiting the combustor back to the combustor for combustion; and the ash collector functions to collect ash.

The combustor includes a bed of sand or other inert granular material. In operation, the bed is "fluidized" at a high temperature sufficient to spontaneously combust fuel entering the combustor.

The combustor normally includes one or more "diffusers" which operate to diffuse the sand bed. The diffusers are turbines or propellers mounted on the end of a rotating staff in a port in the wall of the combustor. The shaft is extendable and retractable from the ports in the combustor wall. In the extended position the shaft angles downward and toward the center of the combustor bed to allow the propeller or turbine to diffuse the sand or other granular material. In the retracted position the shaft along with the attached propeller or turbine is within the port in the wall.

The ports housing the diffusers are prone to erosion by the impact of abrasive ash and other particulates within the boiler. In the prior art, the ports are flush with the refractory hood by means of trowel, ramming, and/or other manual methods with the refractory of the combustor interior surface. High velocity ash and other particles colliding with the corner of the refractory wall where it meets the diffuser port continually erode the refractory to the point where the shielding and insulating function is diminished. If the diffuser is mounted within a metal tube positioned within the port, as is often the case, the metal tube itself is eroded and the boundary between the metal tube and refractory is the site of additional erosion.

SUMMARY OF THE INVENTION

The present invention is a cast refrac S.U.B.S. for use with a circulating fluidized bed to protect the diffuser port from erosion by fly ash and other particulates. The shield is designed for retrofitting to existing combustors or for installation in newly manufactured combustors.

The head includes a tubular insert adapted to be received by a diffuser port and a shield which is attached to the insert. The shield is roughly donut-shaped, with a substantially flat surface to abut against the combustor refractory wall and a rounded opposite surface to face toward the combustor interior to deflect ash away from the port. The shield is designed to be replaceable from time to time as the shield gradually wears out.

A preferred material for the shield is castable refrac material. Other materials will be apparent to those skilled in the art, provided that the material is resistant to heat and erosion, and can be cast and manufactured into the desired shape.

DETAILED DESCRIPTION OF THE INVENTION

Figure 1:
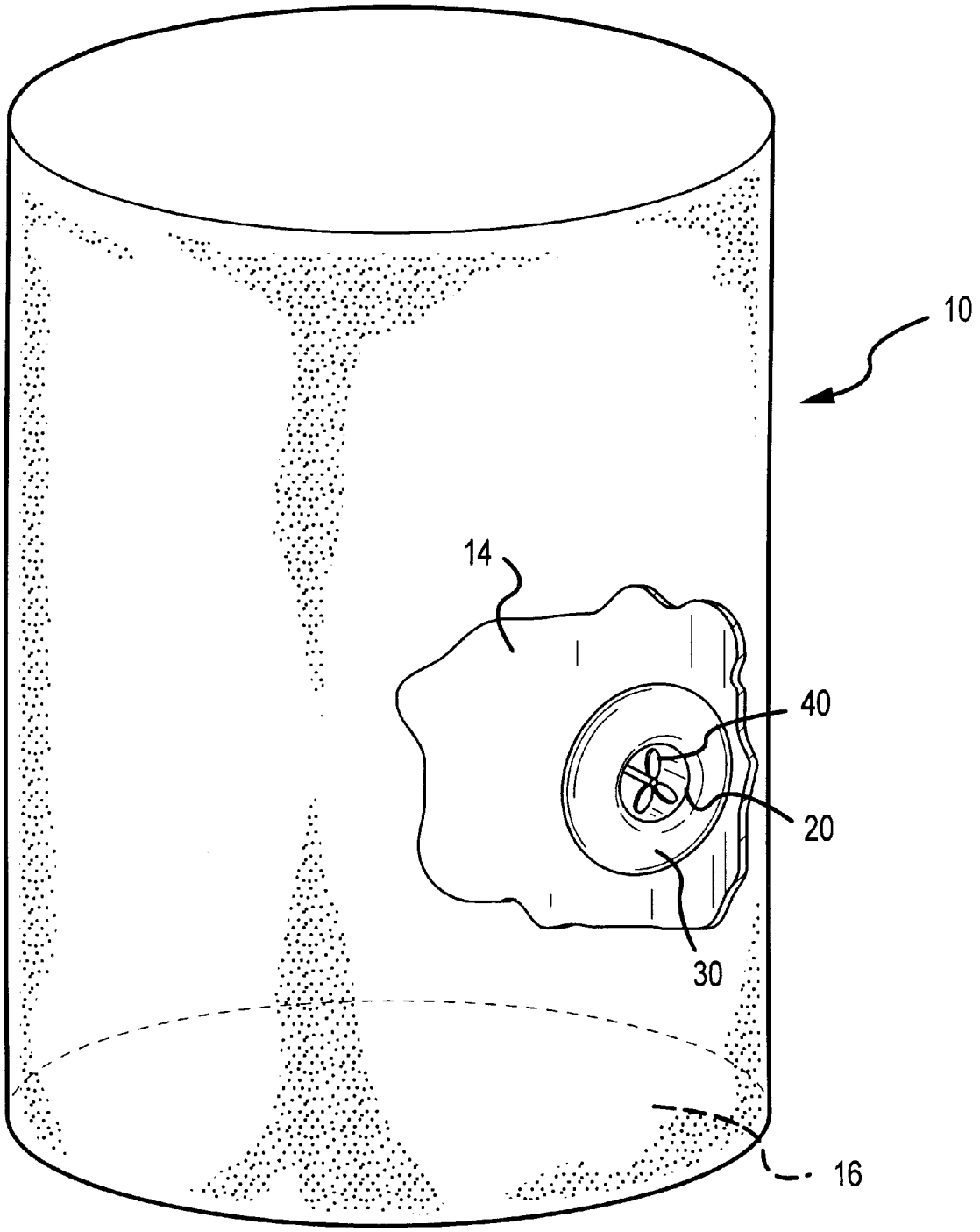
FIG. 1 shows a perspective view of a combustor utilizing a "cast-refrac" S.U.B.S. in accordance with the present invention.

A perspective view of a combustor 10 equipped with a S.U.B.S. 30 in accordance with the present invention, is depicted in FIG. 1. The combustor generally includes a refractory interior wall 14 and a bed 16. In the wall 14 is one or more diffuser ports 20 which in the apparatus shown in FIG. 1 are equipped with S.U.B.S. 30 in accordance with the present invention.

Combustors may be of a variety of specific designs, and it should be appreciated that the somewhat schematic depiction of FIG. 1 represents only one such design. Other designs utilizing diffusers positioned within diffuser ports may also be suitable for use with the present invention.

Figure 2:
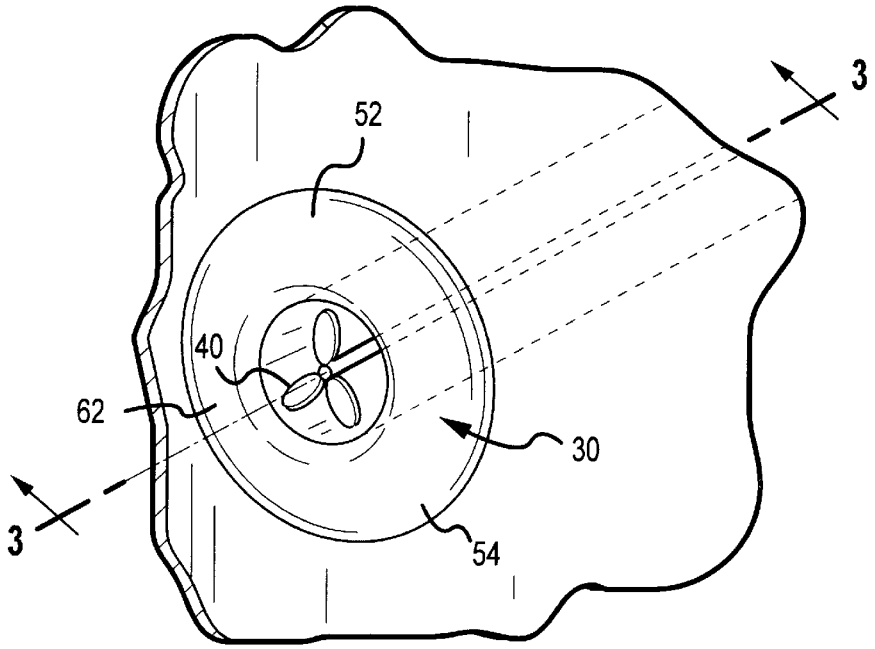
FIG. 2 is a detail perspective view of a S.U.B.S. in the context of a combustor diffuser.
Figure 3:
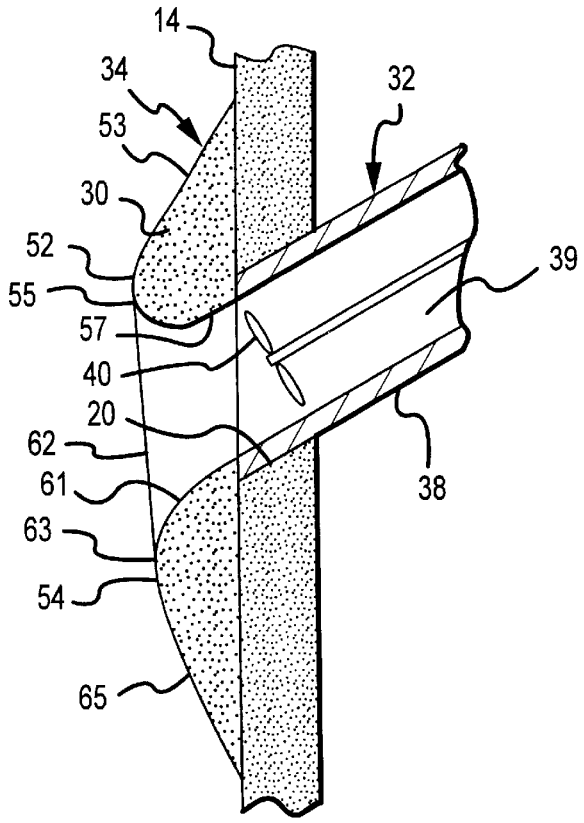
FIG. 3 is a sectional view of a S.U.B.S. in the context of a combustor diffuser, taken along line 3—3 of FIG. 2.

The diffuser hood 30 is shown in greater detail in the detail perspective view of FIG. 2 and the sectional view of FIG. 3. The hood 30 includes a tubular insert 32 and a shield 34. The insert is generally steel or other relatively high strength, durable material. The insert 32 is preferably tubular in shape, having an insert outer wall 38 with an outside diameter to fit snugly in the diffuser port 20 but with an insert inner wall 39 having diameter sufficiently large to allow the diffuser 40 to pass therethrough to its extended state in the combustor interior and to retract to its retracted state within the diffuser port 20. The insert 32 may be attached to the interior wall of the diffuser port 20 by any suitable means such as bolting, welding, or hanging.

The shield 34 includes an upper portion 52 and a lower portion 54. As can be seen best in FIG. 3, the upper portion 52 is generally tear-drop shaped, with an upper surface 53 extending generally downward and away from the combustor wall 14. The upper surface transitions smoothly into a rounded apex 55. The apex 55, in turn transitions smoothly into a lower surface 57. The lower surface mates with insert 32, and is attached thereto by bolting, welding, or hanging.

The shield 30 further includes a lower portion 54. The lower portion 54 is shaped somewhat differently from the upper portion 52, and includes upper surface 61, apex 63 and lower surface 65. The upper surface joins the insert 32 and is attached thereto by bolting, welding, or hanging. The upper surface initially continues the line defined by insert 32, and gradually curves downward to meet rounded apex 63. The apex 63 transitions smoothly into lower surface 65 which extends downward and toward combustor wall 14. The lower surface 65 ultimately meets combustor wall 14 at the lower surface bottom point.

The upper portion 52 and lower portion 54 are joined by intermediate portions 62 on each side of the port 20. The apex 52 of upper portion 52 extends farther from combustor wall 14, and thus farther into the combustor 10 interior, than does the apex 63 of lower portion 54. The result is that the intermediate portions 62 extend slightly toward the combustor wall 14 as they extend downward.

The S.U.B.S. 30 is preferably manufactured or cast from a durable and erosion-resistant material such as a "castable refrac" material determined by the operating temperature, fuel, and other operating criteria. Other materials will also be suitable, and will be apparent to those skilled in the art.

What is claimed is:

1. A device to deflect particulates away from a diffuser port in a circulating fluidized bed combustor, comprising: a circular shield portion having a substantially flat surface on one side, a rounded surface on an opposite side, and a hole therethrough, the hole having a size substantially the same as the diffuser port; and a tubular insert attached to the shield, the tubular insert having a diameter to allow insertion into the diffuser port; wherein the opposite side has in cross-section: a tear-drop shaped upper portion having a first apex; a lower portion having a second apex with less extension from said flat surface than said first apex; and an intermediate portion connecting the upper portion and the lower portion, so that the intermediate portion is inclined downward toward said flat surface.

2. The device of claim 1, wherein the shield portion is made of a castable refrac material.

* * * * *